US006826440B2

(12) United States Patent
Yamamoto

(10) Patent No.: US 6,826,440 B2
(45) Date of Patent: Nov. 30, 2004

(54) EXPERIMENTAL MANAGEMENT APPARATUS AND EXPERIMENTAL MANAGEMENT PROGRAM FOR ELECTROPLATING

(75) Inventor: Wataru Yamamoto, Tokyo (JP)

(73) Assignee: Yamamoto-MS Co., Ltd., Tokyo (JP)

( * ) Notice: Subject to any disclaimer, the term of this patent is extended or adjusted under 35 U.S.C. 154(b) by 292 days.

(21) Appl. No.: 10/076,493

(22) Filed: Feb. 19, 2002

(65) Prior Publication Data

US 2002/0147519 A1 Oct. 10, 2002

(30) Foreign Application Priority Data

Apr. 5, 2001 (JP) ..... 2001-106585

(51) Int. Cl.[7] ..... G06F 19/00
(52) U.S. Cl. ..... 700/108; 700/52; 700/109
(58) Field of Search ..... 700/108, 109, 700/52; 702/1, 19; 707/6; 205/81

(56) References Cited

U.S. PATENT DOCUMENTS 5,841,678 A * 11/1998 Hasenberg et al. ..... 703/6
6,393,367 B1 * 5/2002 Tang et al. ..... 702/19
6,463,347 B1 * 10/2002 Nevruz et al. ..... 700/108
6,468,410 B1 * 10/2002 Donne ..... 205/81

FOREIGN PATENT DOCUMENTS

DE 197 07 981 A1 9/1998

OTHER PUBLICATIONS

Chestnut, Systems Engineering Tools, Copyright 1965, John Wiley & Sons, pp. 148–151.*

* cited by examiner

*Primary Examiner*—Albert W. Paladini
(74) *Attorney, Agent, or Firm*—Sughrue Mion, PLLC

(57) ABSTRACT

There is provided an experimental management apparatus and experimental management program for electroplating that can carry out an electroplating experiment more efficiently and can manage experimental data more efficiently. The electroplating experimental management apparatus has a computer body 1*a*, which includes a central processing unit 101, a program memory 102, and a data memory 103. The program memory 102 stores a predicted value calculation program 102*a* for working out a predicted value of an experimental result based upon a physical property data file 103*a* and an arithmetic expression data file 103*b* read out of the data memory 103; an experimental data management program 102*b* for obtaining experimental data; and a data analysis program 102*c* for working out experimental data at each point of time during experiment based upon analysis of the experimental data obtained by the experimental data management program 102*b*.

2 Claims, 8 Drawing Sheets

FIG.9

9

EXPERIMENTAL RESULT NUMERICAL VALUE FORM

| | | | | | | |
|---|---|---|---|---|---|---|
| NAME OF EXPERIMENT | Wafer Experiment No. 001 | WAFER-Ni001 | YAMAMOTO, Wataru | 10 November, 2000 | | |
| NAME OF PLATING SOLUTION | Nickel-plated-Sulfamic Acid Solution | NAME OF ITEM | Wafer Specimen | MATERIAL OF ITEM | Si/Ti/Cu | |

| PLATING TIME(S) | ELECTRIC CURRENT VALUE(A) | VOLTAGE VALUE(A) | RESISTANCE(BEFORE CURRENT VALUE) | SOLUTION TEMPERATURE(°C) | pH VALUE(pH) | PLATING THICKNESS(μm) | PLATING WEIGHT(g) |
|---|---|---|---|---|---|---|---|
| 0 | XXXX | XXXX | XXXX | XXXX | XXXX | XXXX | XXXX |
| 1 | XXXX | XXXX | XXXX | XXXX | XXXX | XXXX | XXXX |
| 2 | XXXX | XXXX | XXXX | XXXX | XXXX | XXXX | XXXX |
| 3 | XXXX | XXXX | XXXX | XXXX | XXXX | XXXX | XXXX |
| 4 | XXXX | XXXX | XXXX | XXXX | XXXX | XXXX | XXXX |
| 5 | XXXX | XXXX | XXXX | XXXX | XXXX | XXXX | XXXX |
| 6 | XXXX | XXXX | XXXX | XXXX | XXXX | XXXX | XXXX |
| 7 | XXXX | XXXX | XXXX | XXXX | XXXX | XXXX | XXXX |
| 8 | XXXX | XXXX | XXXX | XXXX | XXXX | XXXX | XXXX |
| 9 | XXXX | XXXX | XXXX | XXXX | XXXX | XXXX | XXXX |
| 10 | XXXX | XXXX | XXXX | XXXX | XXXX | XXXX | XXXX |
| 11 | XXXX | XXXX | XXXX | XXXX | XXXX | XXXX | XXXX |
| 12 | XXXX | XXXX | XXXX | XXXX | XXXX | XXXX | XXXX |
| 13 | XXXX | XXXX | XXXX | XXXX | XXXX | XXXX | XXXX |
| 14 | XXXX | XXXX | XXXX | XXXX | XXXX | XXXX | XXXX |
| 15 | XXXX | XXXX | XXXX | XXXX | XXXX | XXXX | XXXX |
| 16 | XXXX | XXXX | XXXX | XXXX | XXXX | XXXX | XXXX |
| 17 | XXXX | XXXX | XXXX | XXXX | XXXX | XXXX | XXXX |
| 18 | XXXX | XXXX | XXXX | XXXX | XXXX | XXXX | XXXX |
| 19 | XXXX | XXXX | XXXX | XXXX | XXXX | XXXX | XXXX |
| 20 | XXXX | XXXX | XXXX | XXXX | XXXX | XXXX | XXXX |
| 21 | XXXX | XXXX | XXXX | XXXX | XXXX | XXXX | XXXX |
| 22 | XXXX | XXXX | XXXX | XXXX | XXXX | XXXX | XXXX |
| 23 | XXXX | XXXX | XXXX | XXXX | XXXX | XXXX | XXXX |
| 24 | XXXX | XXXX | XXXX | XXXX | XXXX | XXXX | XXXX |
| 25 | XXXX | XXXX | XXXX | XXXX | XXXX | XXXX | XXXX |
| 26 | XXXX | XXXX | XXXX | XXXX | XXXX | XXXX | XXXX |
| 27 | XXXX | XXXX | XXXX | XXXX | XXXX | XXXX | XXXX |
| 28 | XXXX | XXXX | XXXX | XXXX | XXXX | XXXX | XXXX |
| 29 | XXXX | XXXX | XXXX | XXXX | XXXX | XXXX | XXXX |
| 30 | XXXX | XXXX | XXXX | XXXX | XXXX | XXXX | XXXX |
| 31 | XXXX | XXXX | XXXX | XXXX | XXXX | XXXX | XXXX |

SAVE IN CSV FORMAT

EXPERIMENTAL MANAGEMENT APPARATUS AND EXPERIMENTAL MANAGEMENT PROGRAM FOR ELECTROPLATING

BACKGROUND OF THE INVENTION

This invention relates to experimental management apparatuses and experimental management programs for electroplating, and more particularly to an apparatus, method, and program for electroplating experimental management that serves to carry out an electroplating experiment more efficiently.

Conventionally, a thickness and weight of plating on a resultant plated object obtained through the electroplating experiment are estimated by substituting various parameters into predetermined arithmetic expressions one by one in order to set experimental conditions of the electroplating experiment. The various parameters include the type of a plating solution; a temperature, pH and concentration of the plating solution; a material, surface area and weight of the plated object; the mode of an electric current; an electric current value, electric current density, time of electric charge, integrated electric current value, electric current rate upon electroplating, and the like.

The conventional method manages an electric current value, a voltage value, an integrated electric current value, a solution temperature, a pH value individually using a rectifier, an ampere-hour meter, a thermometer, a pH meter, or the like.

However, according to the conventional method, in order to set experimental conditions of the electroplating experiment, the various parameters have to be substituted one by one into predetermined arithmetic expressions to work out predicted values of the experimental result, and thus much time and labor are required. Therefore, the method for carrying out the electroplating experiment more efficiently has been demanded.

Further, the conventional method manages experimental data for the electroplating experiment individually, and would thus disadvantageously impair the efficiency in managing the experimental data. In particular, in precise electroplating processes for use in ULSI (ultra large-scale integrated) circuit wiring, micromachine production, or the like, an extremely subtle change in the various parameters would affect the plating result greatly, and thus each parameter has to be set precisely. Accordingly, the necessity of efficiently managing the experimental data has been arising to facilitate determination in setting each parameter.

SUMMARY OF THE INVENTION

The present invention has been produced to eliminate the above disadvantages, and it is an exemplified object of the present invention to provide an apparatus, method, and program for electroplating experimental management that can carry out an electroplating experiment more efficiently, and can manage experimental data more efficiently.

According to one exemplified aspect of the present invention as set forth in claim 1, there is provided an electroplating experiment management apparatus. The electroplating experiment management apparatus comprises: an input means for inputting experimental conditions; a predicted value calculation data storage means for storing in advance physical property value data and arithmetic expression data usable to work out predicted values of experimental results from the experimental conditions; a predicted value calculation means for working out the predicted values of the experimental results from the experimental conditions using the physical property value data and the arithmetic expression data read out from the predicted value calculation data storage means; an experimental data obtaining means for obtaining experimental data; an experimental data analysis mean for working out experimental data at each point of time during an experiment based upon analysis of the experimental data obtained by the experiment data obtaining means; an experimental data recording means for recording the experimental data; and an output means for outputting the experimental conditions, the predicted values, and the experimental data.

According to another aspect of the present invention, there is disclosed an electroplating experiment management method for using a computer to manage an electroplating experiment. The method comprises the steps of: inputting experimental conditions; storing in advance physical property value data and arithmetic expression data usable to work out predicted values of experimental results from the experimental conditions, in a predicted value calculation data storage means; working out the predicted values of the experimental results from the experimental conditions using the physical property value data and the arithmetic expression data read out from the predicted value calculation data storage means; obtaining experimental data; based upon analysis of the experimental data, working out experimental data at each point of time during an experiment; recording the experimental data; and outputting the experimental conditions, the predicted values, and the experimental data. This method may be implemented in the form of a computer program.

According to another aspect of the present invention as set forth in claim 2, there is provided an electroplating experiment management program for managing an electroplating experiment. The electroplating experiment management program allows a computer to operate as: an input means for inputting experimental conditions; a predicted value calculation data storage means for storing in advance physical property value data and arithmetic expression data usable to work out predicted values of experimental results from said experimental conditions; a predicted value calculation means for working out the predicted values of the experimental results from said experimental conditions using the physical property value data and the arithmetic expression data read out from said predicted value calculation data storage means; an experimental data obtaining means for obtaining experimental data; an experimental data analysis mean for working out experimental data at each point of time during an experiment based upon analysis of said experimental data obtained by said experimental data obtaining means; an experimental data recording means for recording said experimental data; and an output means for outputting said experimental conditions, said predicted values, and said experimental data.

Other objects and further features of the present invention will become readily apparent from the following description of preferred embodiments with reference to accompanying drawings.

BRIEF DESCRIPTION OF THE DRAWINGS

FIG. 9 is a diagram showing an EXPERIMENTAL RESULT NUMERICAL VALUE FORM.

DETAILED DESCRIPTION OF THE PREFERRED EMBODIMENTS

A detailed description will be given below of an embodiment of the present invention with reference to the drawings.

Figure 1:
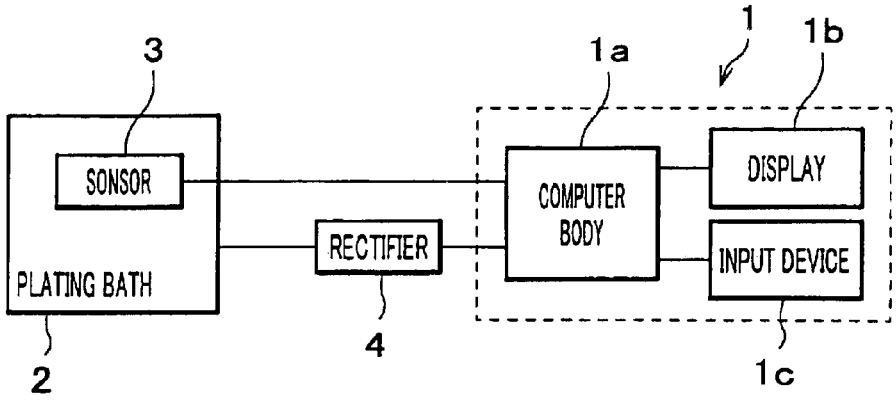
FIG. 1 is a block diagram showing a composition of hardware in which an electroplating experiment is carried out using an electroplating experimental management apparatus according to the present invention.
Figure 2:
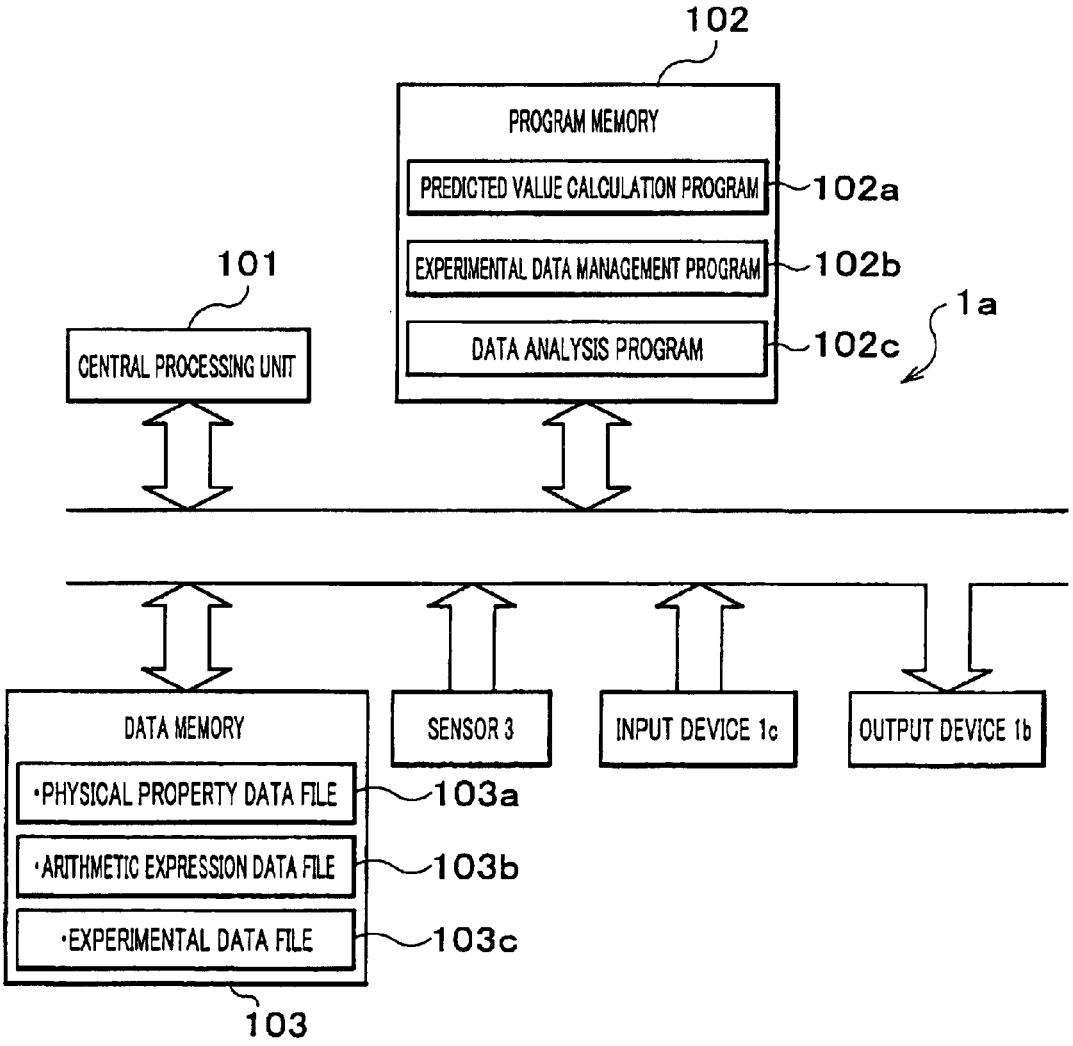
FIG. 2 is a system configuration diagram of an electroplating experimental management apparatus according to the present invention.
Figure 3:
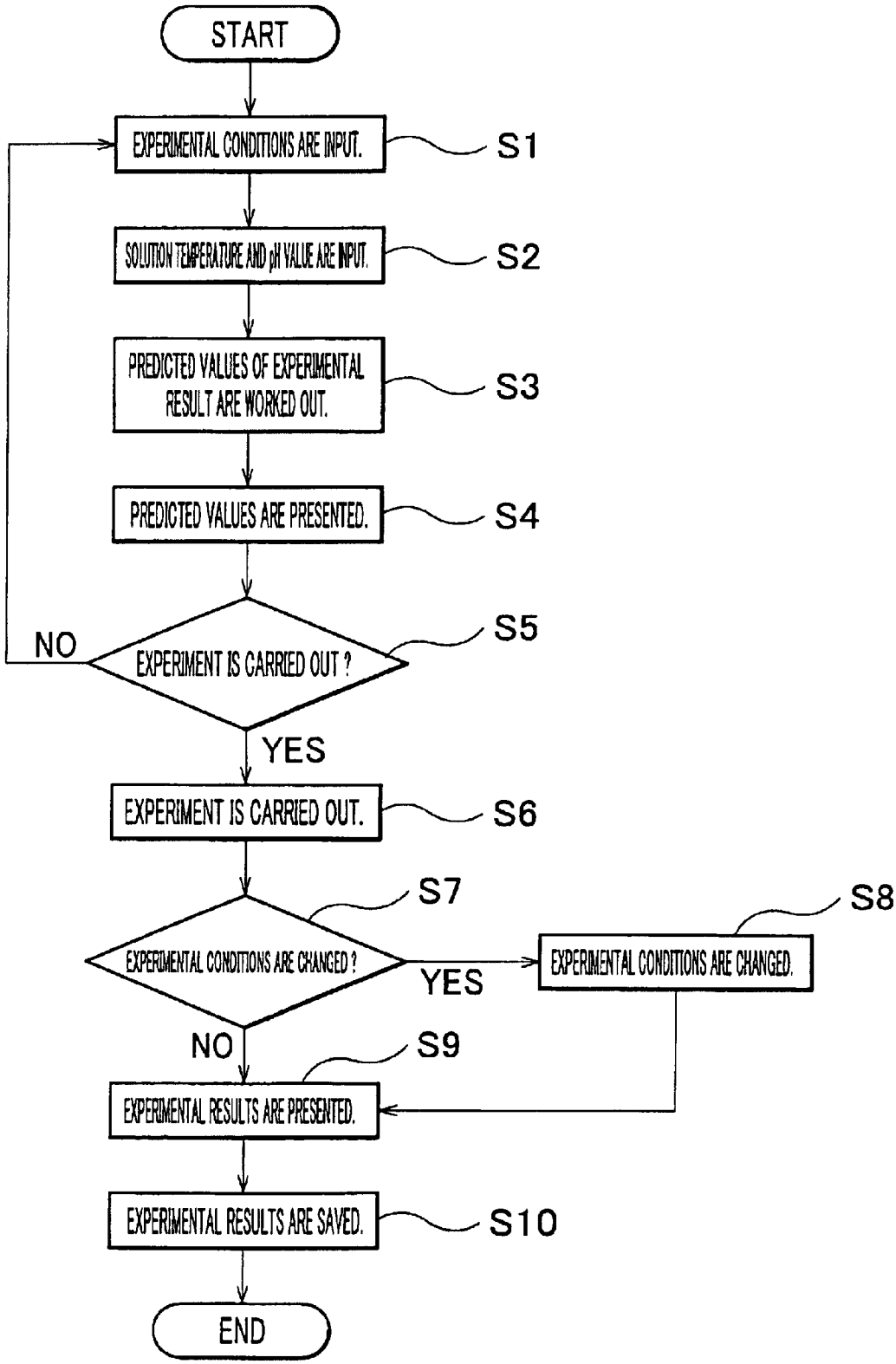
FIG. 3 is a flowchart showing a process for carrying out an electroplating experiment using an electroplating experimental management apparatus according to the present invention.

FIG. 1 is a block diagram showing a composition of hardware in which an electroplating experiment is carried out using an electroplating experimental management apparatus according to the present invention. FIG. 2 is a system configuration diagram of an electroplating experimental management apparatus according to the present invention. FIG. 3 is a flowchart showing a process for carrying out an electroplating experiment using an electroplating experimental management apparatus according to the present invention. FIGS. 4 through 9 are diagrams showing input and output forms each displayed on a screen.

First, a description will be given of an electroplating experimental management apparatus according to the present invention with reference to the block diagram in FIG. 1 and the system configuration diagram in FIG. 2.

As shown in FIG. 1, an electroplating experimental management apparatus 1 is connected respectively with a sensor 3 and a rectifier 4. The sensor 3 is disposed in a plating bath 2 to measure a temperature and pH value of a plating solution. The rectifier 4 is a direct current power source that applies voltage between an anodic metal plate and a cathodic metal plate (both not shown) disposed in the plating solution. The rectifier 4 is under control of the electroplating experimental management apparatus 1.

The electroplating experimental management apparatus 1 includes a computer body 1*a*, a display 1*b* as an output means, and an input device 1*c* as an input means. The display 1*b* is connected with the computer body 1*a*, and used by a user to monitor input/output data. The input device 1*c* is comprised of a keyboard and a mouse, connected with the computer body 1*a*, and used to input general items and experimental conditions concerning the experiment into the computer body 1*a*.

The computer body 1*a* is, as shown in FIG. 2, includes a central processing unit 101, a program memory 102, and a data memory 103. With the computer body 1*a* are connected the sensor 3, input device 1*c*, and display 1*b* through an input/output control part (not shown). Although not shown in FIG. 2, the rectifier 4 is connected with the computer body 1*a* through the output control part.

The program memory 102 stores a predicted value calculation program 102*a* as a predicted value calculation means, an experimental data management program 102*b* as an experimental data obtaining means, and a data analysis program 102*c* as an experimental data analysis means, respectively.

The predicted value calculation program 102*a*, when experimental conditions are input from the input device 1*c*, accesses the data memory 103, reads out a physical property data file 103*a* and arithmetic expression data file 103*b* that will be described later, and works out predicted values of a thickness of plating and a weight of plating obtained as a result of the experiment. The predicted value calculation program 102*a*, when the thickness and weight of plating are input, may calculate back the experimental conditions such as an electrical current value, and time of electric charge from the values of the thickness and weight of plating.

The experimental data management program 102*b* obtains experimental data from the experimental conditions input from the input device 1*c*, and the temperature and pH value of the solution input from the sensor 3.

The data analysis program 102*c* analyzes the experimental data obtained by the experimental data management program 102*b*, and works out experimental data at each point in time during the electroplating experiment, such as an integrated electric current value, a predicted thickness of plating, and a predicted weight of plating.

The data memory 103 stores a physical property value data file 103*a* and arithmetic expression data file 103 b as a predicted value calculation data storage means, and an experimental data file 103*c* as an experimental data storage means, respectively.

The physical property value data file 103*a* includes a variety of physical property value data concerning the plating solution, and a variety of physical property value data concerning the object to be plated.

The arithmetic expression data file 103*b* includes experimental conditions input from the input device 1*c*, and arithmetic expressions to work out predicted values of thickness and weight of plating from a temperature and pH value of the plating solution determined by the sensor 3.

In the experimental data file 103*c* is recorded the experimental conditions input from the input device 1, and a temperature and pH value of plating solution input from the sensor 3. In the experimental data file 103*c* is recorded general items concerning the electroplating experiment input from the input device 1*c*.

Next, a description will be given of a process for carrying out an electroplating experiment using the electroplating experimental management apparatus according to the present invention, with reference to the flowchart shown in FIG. 3, and an input form and output form shown in FIGS. 5 through 9.

First, in step S1, a user operates the input device 1*c* and inputs general items and experimental conditions concerning the experiment into the computer body 1*a*. The general items and experimental conditions are input by filling in "Setting Value Input Form" 5 displayed in the display 1*b* (see FIG. 4).

Undetermined items in the experimental conditions may be kept blank, so that these experimental conditions are calculated back from the experimental results upon completion of the experiment. To be more specific, if the user inputs a desired thickness and weight of plating in the beginning of the experiment, the predicted value calculation program 102*a* automatically works out other experimental conditions after the completion of the experiment.

Figure 4:
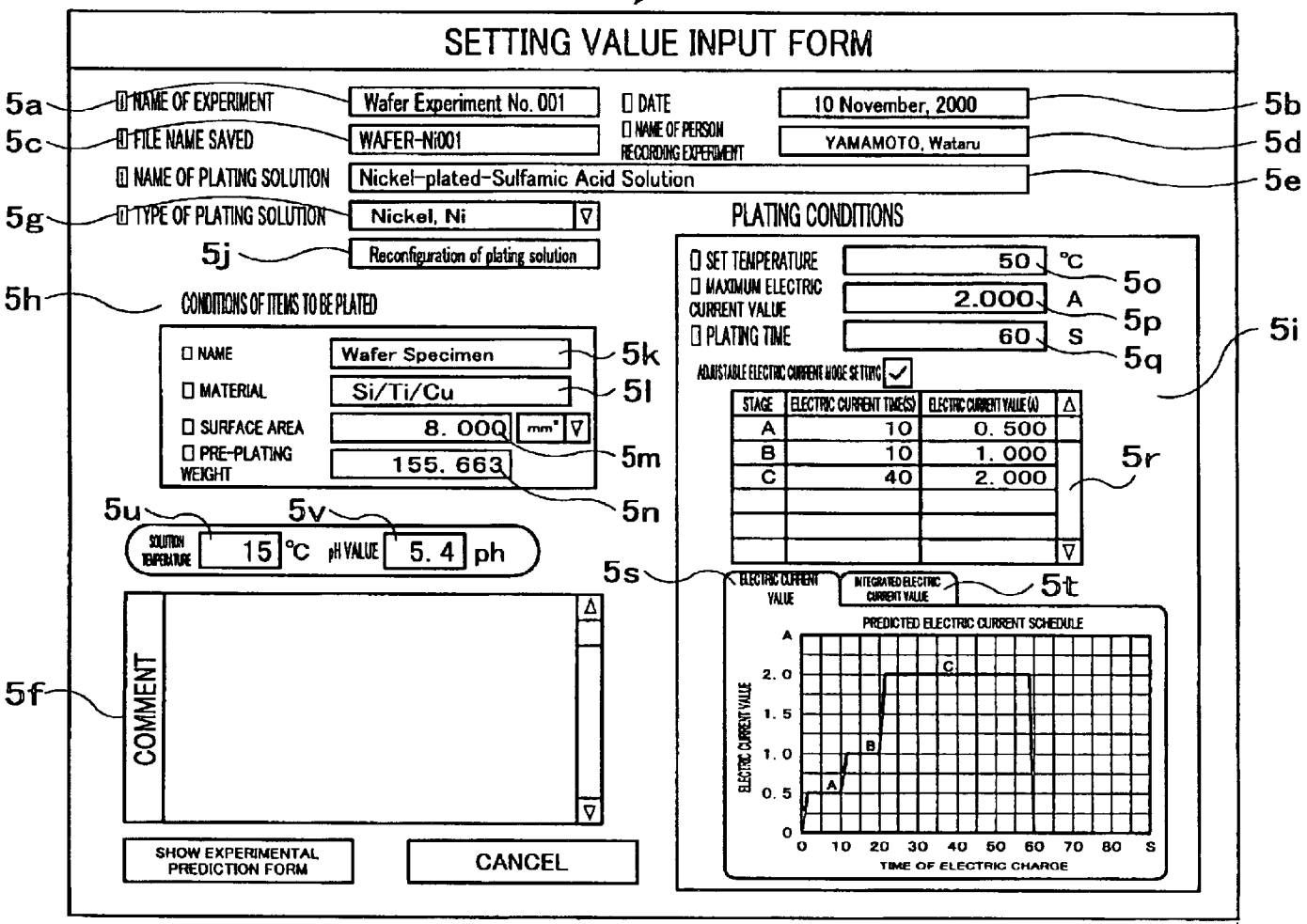
FIG. 4 is a diagram showing a SETTING VALUE INPUT FORM.

As shown in FIG. 4, included among the general items concerning the experiment are "Name of Experiment" 5*a*, a "Date" 5*b*, a "File Name Saved" 5*c*, a "Name of Person Recording Experiment" 5*d*, and a "Name of Plating Solution" 5*e* which are displayed in an upper portion of the screen. A "Comment" 5*f* is displayed in a lower left-side portion of the screen, so that the user may input a comment concerning the experiment as appropriate in the "Comment" 5*f*.

Among the experimental conditions are a "Type of Plating Solution" 5*g*, a "Conditions of Items to be Plated" 5*h*, and a "Plating Conditions" 5*i*.

Figure 5A:
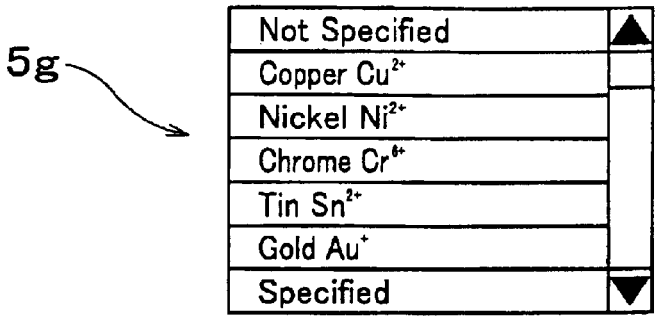
FIG. 5A is a diagram showing a menu that appears when a column 5*g* in the setting value input form shown in FIG. 4 is clicked.
Figure 5B:
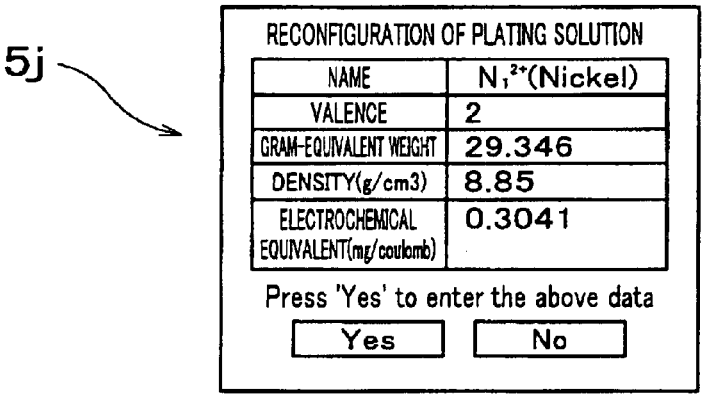
FIG. 5B is a diagram showing a dialog box that opens when a button 5*j* in the SETTING VALUE INPUT FORM shown in FIG. 4 is pressed.

The "Plating Conditions" 5*i*, as shown in FIG. 5A may be selected from a list of options of the prepared types of plating solution in a pull-down menu that appears when the column is clicked. As shown in FIG. 5B, a dialog box for inputting the "Reconfiguration of Plating Solution" 5*j* may be opened to reconfigure the physical properties of the plating solution.

The "Conditions of Items to be Plated" 5*h* includes a "Name" 5*k*, a "Material" 51, a "Surface Area" 5*m*, and a "Pre-Plating Weight" 5*n*. The unit of the "Surface Area" 5*m* may be selected from a list of options in a pull-down menu that appears when a column provided at the right side of the "Surface Area" 5*m* column is clicked.

Figure 5C:
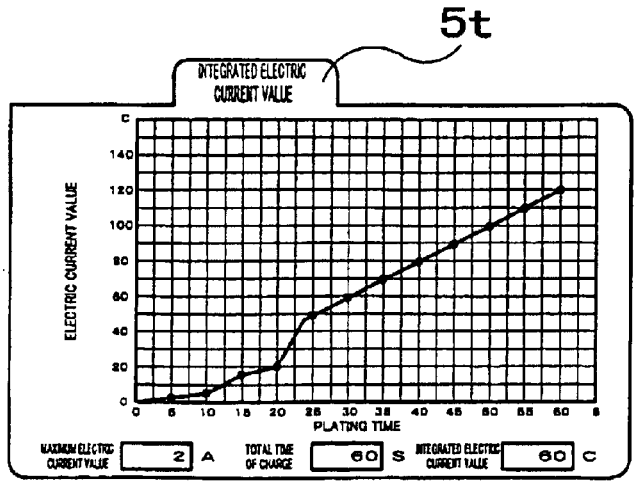
FIG. 5C is a diagram showing a graph for indicating an integrated electric current value that appears when a tab 5*t* in the setting value input form shown in FIG. 4 is pressed.

The "Plating Conditions" 5*i* includes a "Set Temperature" 5*o*, a "Maximum Electric Current Value" 5*p*, a "Plating Time" 5*q*, and a "Adjustable Electric Current Mode Setting" 5*r*; "Electric Current Value" 5*s* is graphed in a lower right-side portion of the screen. By clicking the tab, an "Integrated Electric Current Value" 5*t* may be presented in a graph as shown in FIG. 5C instead of the "Electric Current Value" 5*s*. The "Integrated Electric Current Value" 5*t* is automatically worked out by the predicted value calculation program 102*a*.

In subsequent step S2, a solution temperature and pH value of the plating solution that are determined by the sensor 3 provided in the plating bath 2 are input into the computer body 1*a*. The input solution temperature and pH value are presented in a "Solution Temperature" 5*u* and a "pH Value" 5*v* of the "Setting Value Input Form" 5 shown in FIG. 4.

Optionally, the user may be given an on-screen message in the display 1*b*, or an alarm or warning voice from an optionally provided sound generator through a speaker or the like, if the "Solution Temperature" 5*u* and/or "pH Value" 5*v* of the plating solution does not meet the experimental conditions input by the user.

In step S3, the central processing unit 101 receives an instruction from the predicted value calculation program 102*a*, reads out the physical property data 103*a* and arithmetic expression data 103*b* from the data memory 103, and works out predicted values of plating thickness and plating weight from the solution temperature and pH value of the plating solution input in step S1.

Figure 6:
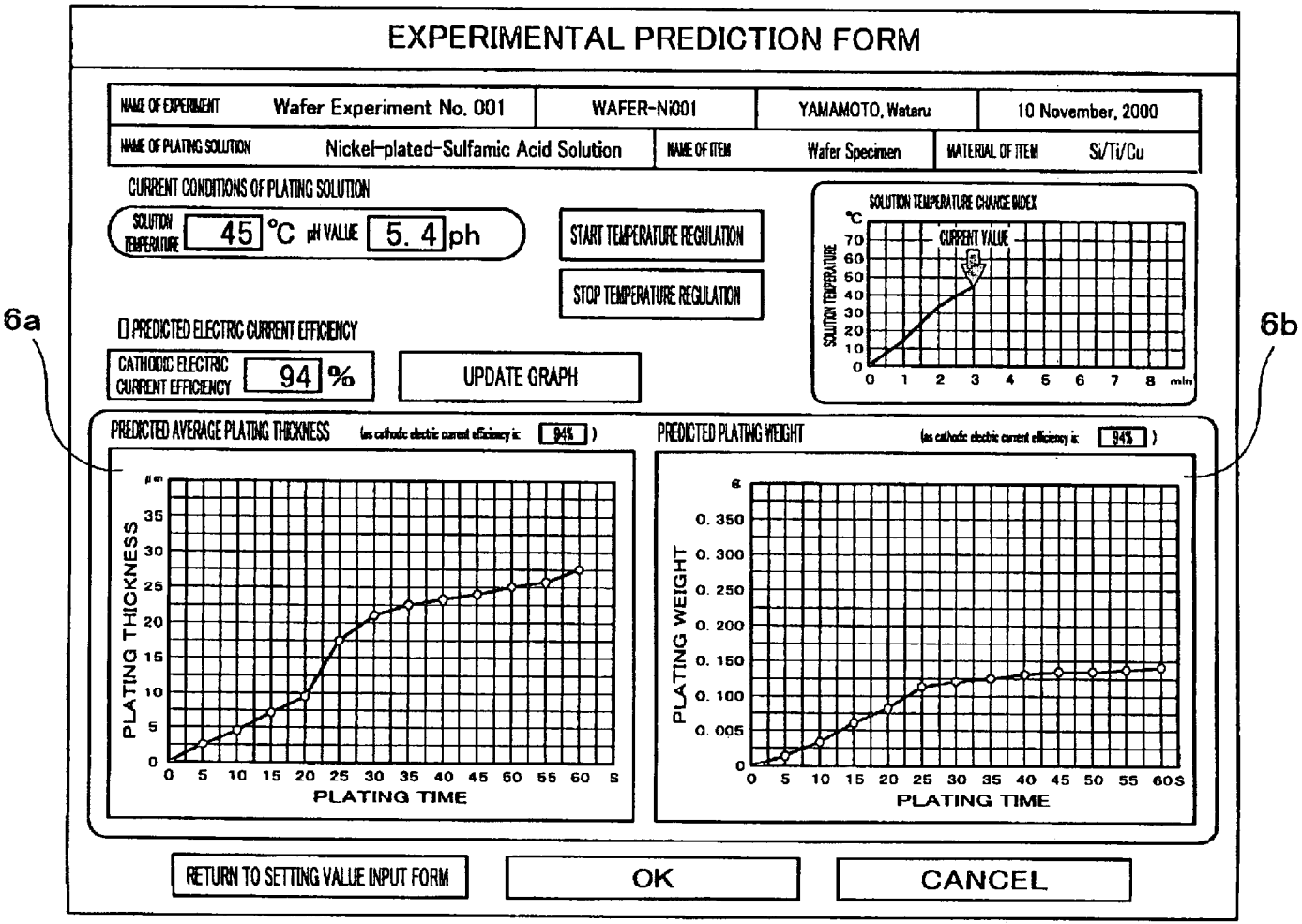
FIG. 6 is a diagram showing an EXPERIMENTAL PREDICTION FORM.

In following step S4, the predicted values of plating thickness and plating weight are presented in the display 1*b* as a "Experimental Prediction Form" 6 shown in FIG. 6. The predicted values of plating thickness and plating weight are graphed respectively as a "Predicted Average Plating Thickness" 6*a* and a "Predicted Plating Weight" 6*b*. It is to be understood that no particular limitation is placed upon the method for presenting the predicted values of the plating thickness and plating weight.

In step S5, the user checks the "Predicted Average Plating Thickness" 6*a* and "Predicted Plating Weight" 6*b* presented in the "Experimental Prediction Form" 6, and determines whether to carry out the electroplating experiment practically. If the user determines to carry out the experiment, then the user proceeds to the next step S6. On the contrary, if the user determines not to carry out the experiment, the user returns to the preceding step S1 to reenter the experimental conditions.

In step S6, the electroplating experiment is carried out based upon the experimental conditions input in step S1, and the solution temperature and pH value of the plating solution input in step S2. The solution temperature and pH value of the plating solution during the experiment are measured in real time, and presented in the display 1*b* as an "Experimental Form" 7 as shown in FIG. 7.

Figure 7:
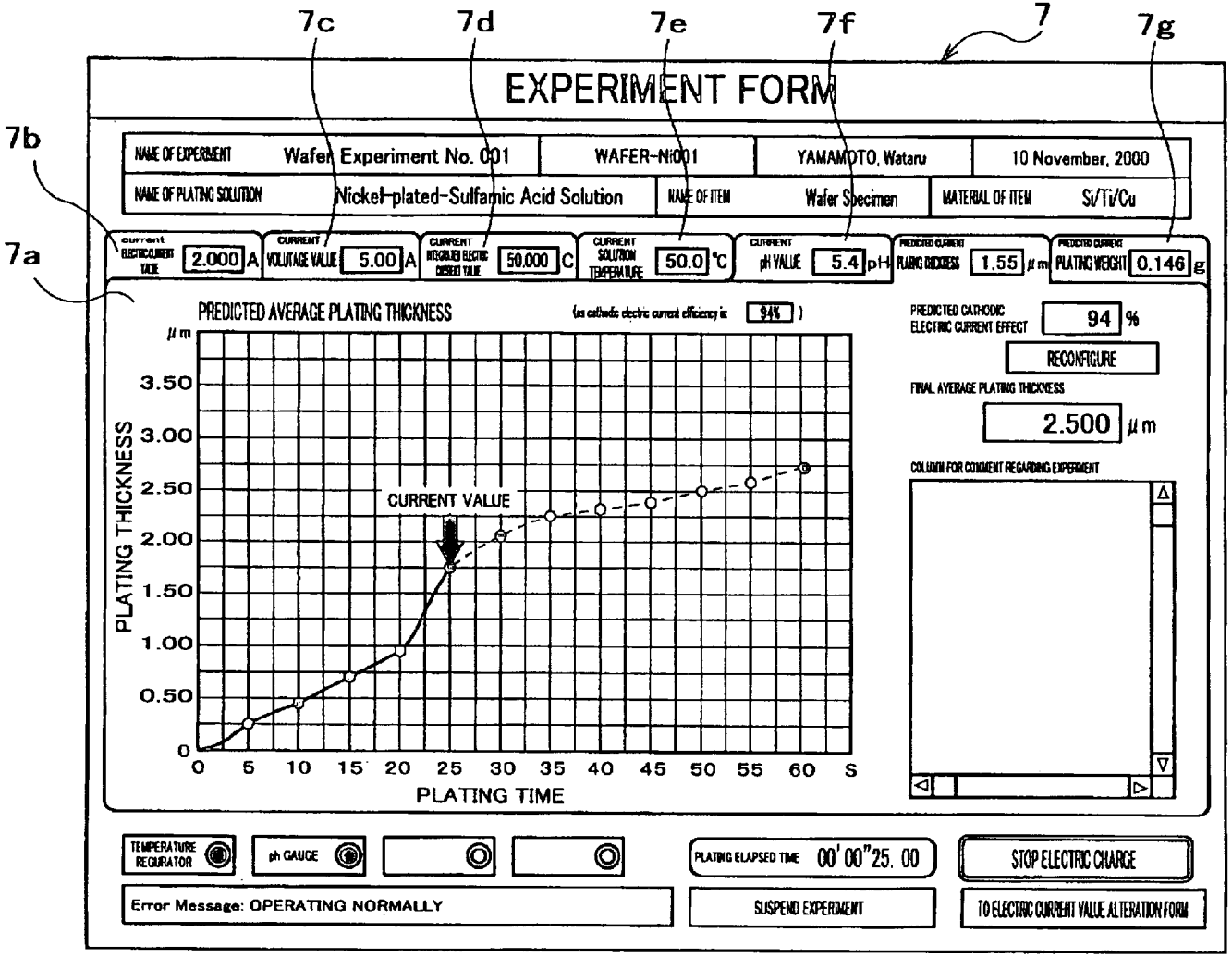
FIG. 7 is a diagram showing an EXPERIMENT FORM.

A "Predicted Current Plating Thickness" 7*a* is graphed in the "Experimental Form" 7 shown in FIG. 7; however, a "Current Electric Current Value" 7*b*, a "Current Voltage Value" 7*c*, a "Current Integrated Electric Current Value" 7*d*, a "Current Solution Temperature" 7*e*, a "Current pH Value" 7*f*, and a "Predicted Current Plating Weight" 7*g* may be presented respectively by clicking each tab. The "Predicted Current Plating Thickness" 7*a*, "Current Integrated Electric Current Value" 7*d*, and "Predicted Current Plating Weight" 7*g* are automatically worked out by the predicted value calculation program 102*a*.

If the user specifies an arbitrary point of time on the graph presented in the "Experimental Form" 7 with a mouse, the user may view experimental data obtained at each point of time during the electroplating experiment. The experimental data obtained at each point of time during the electroplating experiment are automatically worked out by the data analysis program 102*c*.

The experimental data are obtained by the experimental data management program 102*b* at all times, and recorded in the experimental data file 103*c* in the data memory 103.

In subsequent step S7, the user checks the "Experimental Form" 7 in FIG. 7, and determines whether to change the experimental conditions such as the electric current value, the time of electric charge, and the like. If the user determines to change the experimental conditions, the user proceeds to step S8. If the user determines not to change the experimental conditions, the user proceeds to subsequent step S9.

In step S8, the experimental conditions such as the electric current value, the time of electric charge, and the like are changed. There are no special limitations upon the method for changing the experimental conditions such as the electric current value, the time of electric charge, and the like. For instance, a new input form for changing the experimental conditions may be provided to change the experimental conditions by filling out the input form. Alternatively, the "Experimental Form" 7 in FIG. 7 may be configured to serve to accept changes in the experimental conditions directly. After the experimental conditions are changed, the experiment continues again.

Figure 8:
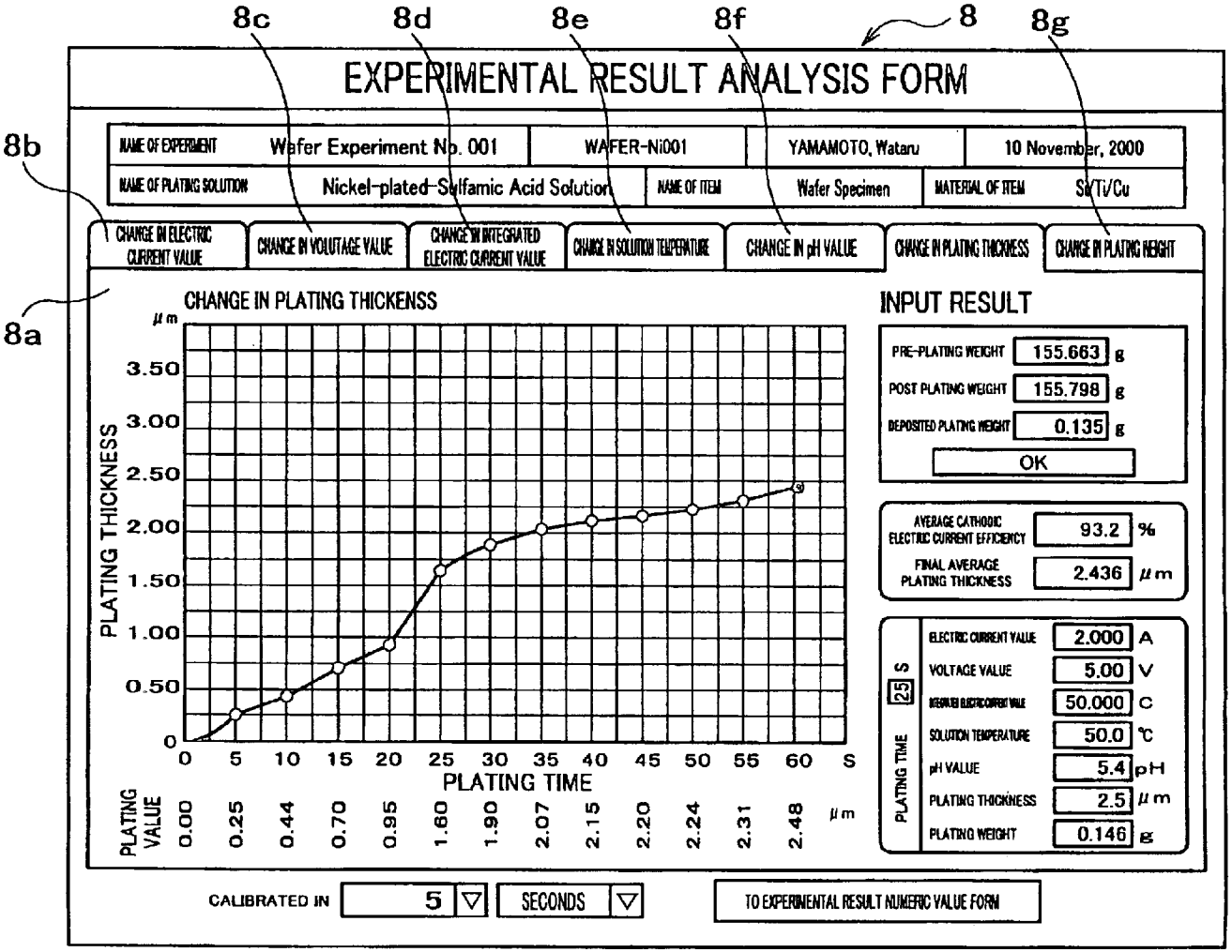
FIG. 8 is a diagram showing an EXPERIMENTAL RESULT ANALYSIS FORM.

In the next step 9, the experimental results of the electroplating experiment are presented in the display 1*b* as an "Experimental Result Analysis Form" 8 as shown in FIG. 8. The experimental results are automatically worked out by the data analysis program 102*c*.

The "Experimental Result Analysis Form" 8 in FIG. 8 shows a "Change in Plating Thickness" 8*b* with a graph. Alternatively, a "Change in Electric Current Value" 8*b*, a "Change in Voltage Value" 8*c*, a "Change in Integrated Electric Current Value" 8*d*, a "Change in Solution Temperature" 8*e*, a "Change in pH Value" 8*f*, and a "Change in Plating Weight" 8*g* may be presented respectively by clicking each tab.

Thereafter, in step S10, the experimental results of the electroplating experiment are saved. The experimental results are saved in the form of a "Experimental Result Numerical Value Form" 9 as shown in FIG. 9 in the experimental data file 103*c*. The saved experimental results are utilized when the predicted value calculation program 102*a* predicts experimental results in the following electroplating experiments.

Alternatively, the experimental results may be saved as a numeric data in the CSV (comma separated value) format that may be used in a commonly available database software, and spread sheet software. It is to be understood that no particular limitations are placed upon formats in which the experimental results are saved.

Although exemplified embodiments of the experimental management apparatus and experimental management program for electroplating according to the present invention have been described above, the present invention is not limited thereto, and various modifications and changes may be made in the present invention without departing from the spirit and scope thereof.

As described above, according to the present invention, predicted values of plating thickness and plating weight as experimental results may be easily worked out when an electroplating experiment is carried out; thus the electroplating experiment may be efficiently carried out. Moreover, experimental data may be automatically recorded all together, so that the experimental data may be efficiently managed.

Further, undetermined items in the experimental conditions could be easily calculated back from the experimental result; therefore, the electroplating experiment and experimental data management would be facilitated.

Furthermore, the progress and result of the electroplating experiment may be monitored; thus a burden imposed on a user who manages the electroplating experiment is significantly alleviated.

What is claimed is:

1. An electroplating experiment management apparatus comprising:

an input means for inputting electroplating experimental conditions;

a predicted value calculation data storage means for storing in advance physical property value data and arithmetic expression data usable to work out predicted values of electroplating experimental results from said electroplating experimental conditions;

a predicted value calculation means for working out the predicted values of the electroplating experimental results from said electroplating experimental conditions using the physical property value data and the arithmetic expression data read out from said predicted value calculation data storage means;

an electroplating experimental data obtaining means for obtaining electroplating experimental data;

an electroplating experimental data analysis mean for working out electroplating experimental data at each point of time during an electroplating experiment based upon analysis of said electroplating experimental data obtained by said electroplating experimental data obtaining means;

an electroplating experimental data recording means for recording said electroplating experimental data; and an output means for outputting said electroplating experimental conditions, said predicted values, and said electroplating experimental data.

2. An electroplating experiment management program for managing an electroplating experiment, said program allowing a computer to operate as:

an input means for inputting electroplating experimental conditions;

a predicted value calculation data storage means for storing in advance physical property value data and arithmetic expression data usable to work out predicted values of electroplating experimental results from said electroplating experimental conditions;

a predicted value calculation means for working out the predicted values of the electroplating experimental results from said electroplating experimental conditions using the physical property value data and the arithmetic expression data read out from said predicted value calculation data storage means;

an electroplating experimental data obtaining means for obtaining electroplating experimental data;

an electroplating experimental data analysis mean for working out electroplating experimental data at each point of time during an electroplating experiment based upon analysis of said electroplating experimental data obtained by said electroplating experimental data obtaining means;

an electroplating experimental data recording means for recording said electroplating experimental data; and an output means for outputting said electroplating experimental conditions, said predicted values, and said electroplating experimental data.

* * * * *